US008128375B2

(12) United States Patent
Girard et al.

(10) Patent No.: US 8,128,375 B2
(45) Date of Patent: Mar. 6, 2012

(54) TURBOMACHINE BLADE THAT IS CAST WITH A LOCAL FATTENING OF THE SECTION OF THE AIRFOIL

(75) Inventors: Patrick Joseph Marie Girard, Saint Fargeau Ponthierry (FR); Jean-Claude Marcel Auguste Hanny, Paris (FR); Renaud Martet, Palaiseau (FR); Olivier Charles Henri Massy, Paris (FR); Philippe Jean-Pierre Pabion, Vaux le Penil (FR); Stephanie Dominique Roger, Mormant (FR)

(73) Assignee: SNECMA, Paris (FR)

( * ) Notice: Subject to any disclaimer, the term of this patent is extended or adjusted under 35 U.S.C. 154(b) by 615 days.

(21) Appl. No.: 12/333,969

(22) Filed: Dec. 12, 2008

(65) Prior Publication Data

US 2009/0155085 A1 Jun. 18, 2009

(30) Foreign Application Priority Data

Dec. 14, 2007 (FR) ..... 07 08751

(51) Int. Cl.
*B63H 1/26* (2006.01)

(52) U.S. Cl. ..... 416/223 R; 416/234; 416/239; 416/243; 415/191; 415/208.1; 415/210.1

(58) Field of Classification Search ..... 415/191, 415/208.1, 210.1; 416/234, 239, 223 R, 416/243

See application file for complete search history.

(56) References Cited

U.S. PATENT DOCUMENTS

| | | | | |
|---|---|---|---|---|
| 2005/0220625 | A1 * | 10/2005 | Chandraker | 416/223 R |
| 2006/0137179 | A1 * | 6/2006 | Gorman et al. | 29/889.1 |
| 2008/0159869 | A1 * | 7/2008 | Ruehr et al. | 416/223 R |
| 2009/0238694 | A1 * | 9/2009 | Cunha | 416/97 R |

FOREIGN PATENT DOCUMENTS

| | | | |
|---|---|---|---|
| EP | 0 441 097 | A1 | 8/1991 |
| EP | 0 833 060 | A2 | 4/1998 |
| EP | 1 688 586 | A1 | 8/2006 |

* cited by examiner

*Primary Examiner* — Michelle Estrada

(74) *Attorney, Agent, or Firm* — Oblon, Spivak, McClelland, Maier & Neustadt, L.L.P.

(57) ABSTRACT

The monocrystalline turbomachine blade according to the invention that is cast and directionally solidified, is disclosed. The blade includes an airfoil with a leading edge, a pressure face, a suction face, a trailing edge, a skeleton and having a longitudinal axis, the faces and having a neck line, respectively a pressure face neck and a suction face neck relative to the adjacent blade in the turbomachine rotor of which it forms an element; an endpiece of the airfoil, such as a heel or a platform, having an airfoil end face, on the stream side, forming an angle with the axis ZZ; and a connection zone between the airfoil and the airfoil end face. The connection zone forms a fattening of the airfoil. The connection zone extends about the leading edge between a point P1 situated on the suction face of the airfoil upstream of the suction face neck and a point P3 situated on the pressure face of the airfoil upstream of the pressure face neck.

15 Claims, 3 Drawing Sheets

TURBOMACHINE BLADE THAT IS CAST WITH A LOCAL FATTENING OF THE SECTION OF THE AIRFOIL

BACKGROUND OF THE INVENTION

The present invention relates to turbomachine blades. It relates to the turbomachine blades or turbomachine modules, such as compressor or turbine modules, that are cast, and in particular it relates to the fattening of the connection zone between the airfoil and its heel or the airfoil and the associated platform.

The blades that are cast in nickel-based or cobalt-based superalloys are manufactured according to the technique called cire perdue. These blades have columnar or monocrystalline metallurgical structures obtained by a method of directional solidification. This method is awkward to control, particularly for hollow and greatly three-dimensional parts.

The manufacture of such blades involves the production of a model made of wax or another equivalent material, which includes an inner part forming a casting core and depicting the cavities of the blade. To form the model, an injection mold for wax is used in which the core is placed and the wax is injected into it. The wax model is then dipped several times in slurries made of a suspension of ceramic particles in order to produce a shell mold. The wax is removed and the shell mold is baked. The blade is obtained by pouring a molten metal which occupies the empty spaces between the inner wall of the shell mold and the core. Thanks to a nucleus, or an appropriate selector, and controlled cooling, the metal solidifies into a desired crystalline structure. Depending on the nature of the alloy and the expected properties of the part resulting from the cast, it may be a columnar-structure directional solidification, a monocrystalline-structure directional solidification or equiaxis (EX) solidification. After the solidification of the alloy, the shell and the core are knocked out, and the desired blade emerges.

The solidification is a time during which the metal sustains considerable thermal stresses; these stresses often cause the metal to recrystallize. Specifically, on raw cast monocrystalline solid blades, considerable zones of well-defined recrystallization are found. For example, when the blade has a heel, there are recrystallized zones on the airfoil, under the heel, approximately 10 mm under the airfoil-heel connection, as is shown in FIG. 1. The cause of the recrystallization on these blades is the excessive stresses imposed on the metal during solidification.

To attempt to remedy this problem and remove the defect of recrystallization, several tests have been run that have not provided concrete solutions. The size of the casting supplies has been reduced or else the wall of the shell mold has been lightened. Another method tested to remedy this problem has been to add various types of extra thicknesses or swellings locally over the whole periphery of the airfoil immediately beneath the heel. Such a fattening is obtained by changing the wax model from which the model is made. Examples of changes to the roots are shown in FIGS. 2*a*, 2*b* and 2*c*.

The root, or extra thickness, is defined by a height and a thickness on the pressure side and the suction side. The connection zone extends over the whole periphery of the airfoil. Tests have made it possible to find the influence of the geometry of the root on the recrystallization. FIG. 2*a* shows a root with a thickness a of 2 mm and a height h of 5 mm. FIG. 2*b* shows a root with a thickness a of 2 mm and a height 2*h* of 10 mm. FIG. 2*c* shows a root with a thickness a' of 3 mm and a height 2*h* of 10 mm. It was possible to eliminate the recrystallization phenomenon only with a root of a relatively large size making it easier to cast the molten metal between the airfoil and the heel.

But, because of this size, the root is not satisfactory from an aerodynamic point of view: on the one hand, it creates a nominal tangential step in the stream, generated by the truncation of the outer stream radius, and, on the other hand, its presence over the whole profile considerably disrupts the aerodynamic performance of the turbomachine.

In addition, such a root induces no small increase in weight and an abrupt increase in the law of the section. The main consequences are, on the one hand, an increase in the centrifugal stresses on the airfoil and therefore a sharp reduction in service lives, notably in creep, and, on the other hand, an incorrect positioning of the center of gravity in a section at the heel, meaning an increase in the local stresses of the airfoil under the heel or on the disk, bringing a reduction in the service life and in the overspeed margin.

DESCRIPTION OF THE PRIOR ART

Also known are the patent applications published under the numbers EP0833060, EP0441097 and EP1688586 which disclose compressor or turbine blades having thickenings or lateral extensions of the airfoil to improve the aerodynamic flow between the blades.

SUMMARY OF THE INVENTION

To remedy these disadvantages, the applicant has set itself the objective of producing a root that is satisfactory both with respect to the flowability of the molten metal into the shell mold, the aerodynamic stresses to be observed and the mechanical behavior of the part in use on the turbomachine.

DESCRIPTION OF THE PREFERRED EMBODIMENTS

Therefore, the object of the invention is the construction of a blade, with the placing of a local thickening of the section of the airfoil, called the root, that is favorable with respect to the criteria specified above. In order to satisfy these criteria, the thickening is applied to a particular surface of the airfoil, mainly on the leading edge, pressure face and suction face over a defined height.

According to the invention, a monocrystalline turbine blade for a turbomachine turbine rotor cast and directionally solidified, comprising:

- an airfoil with a leading edge BA, a pressure face FI, a suction face FE, a trailing edge BF, a skeleton S and having a longitudinal axis ZZ, the faces FI and FE having a neck line, respectively a pressure face neck CI and a suction face neck CE relative to the adjacent blade in the turbomachine rotor of which it forms an element,
- an endpiece of the airfoil, such as a heel or a platform, having an airfoil end face, on the stream side, forming an angle with the axis ZZ and
- a connection zone between the airfoil and said airfoil end face, said connection zone forming a fattening of the airfoil,
- is characterized in that said connection zone extends about the leading edge BA between a point P1 situated on the suction face FE of the airfoil and on the end face of the heel upstream of the suction face neck CE with reference to the direction of flow of the fluid and a point P3 situated on the pressure face FI of the airfoil and on the end face of the heel upstream of the pressure face neck CI.

Therefore in this way the invention makes it possible to solve the problem of the flowability of the molten metal while ensuring both aerodynamic performance and mechanical strength.

It has consisted in defining a fattening of material, on a particular surface of the airfoil, mainly on the leading edge, pressure face and suction face and over a defined height, making it possible to observe the multi-disciplinary criteria.

The advantage of the invention is that it prevents recrystallization while complying with the aerodynamic criteria and makes it possible to enhance the service life of the airfoil.

The invention applies to all rough cast turbomachine blades whether they are fixed or mobile, placed in a noncylindrical stream. The invention is explained for fattenings on the leading edge between the airfoil and the upper stream, but may also be applied to fattenings on the leading edge between the airfoil and the lower stream if the conicity of the stream means that it is needed.

Advantageously, the section of said airfoil in the connection zone, measured perpendicularly to the leading edge of the theoretical profile, increases as it goes toward said heel, while remaining less than the section of the blade in its lower portion.

This produces a limitation in the increased weight at the end of the airfoil and only slightly diminishes its mechanical strength.

According to another feature of the invention, the line of the points P2 situated furthest upstream relative to the direction of flow of the fluid in the connection zone is situated in line with the leading edge BA of the airfoil on the skeleton S.

According to another feature, the airfoil end face excluding the fillets for connection to the airfoil end face and to the leading edge BA of the blade, is rectilinear and forms with the airfoil end face an angle $\alpha$ with the line of the points P2 that is at least equal to 75° and less than 90°.

According to another feature of the invention also, the curvature of the connection zone, in at least one sectional plane perpendicular to the leading edge of the theoretical profile, at the corresponding point of the line of the points P2 is a function of the curvature of the leading edge and of the distance separating, in said sectional plane, the point of the line of the points P2 from the leading edge of the airfoil. As a reminder: the curvature at a point is equal to the radius of the circle inscribed in the profile at the point.

Preferably, the radius of curvature at said point of the line of the points P2 is equal to the corresponding radius of curvature on the theoretical profile BAv, plus a third of the length I1 as defined below.

According to another feature, the surface of the connection zone at P1 situated on the suction face FE on the one hand and the surface of the connection zone at P3 situated on the pressure face F1 on the other hand, is tangential to the airfoil.

According to another feature, the surface of the connection zone has a profile C1 between the line of the points P2 and the point P1 situated on the suction face FE which is deduced, at least partially, from that of the suction surface FEv of the theoretical airfoil by a combination of geometric transformations of the translation, change of scale and/or affinity type with linking portions ensuring continuity with the rest of the profile of the airfoil.

According to another feature, the surface of the connection zone has a profile C3 between the line of the points P2 and the point P3 situated on the pressure face FI which is deduced, at least partially, from that of the pressure surface FIv of the theoretical airfoil by a combination of geometric transformations of the translation, change of scale and/or affinity type, with linking portions ensuring continuity with the rest of the profile of the airfoil.

According to another feature, the position of the point P3 situated on the pressure face is determined so as to optimize the position of the center of gravity of the connection zone. In at least one sectional plane perpendicular to the leading edge of the theoretical profile, the center of gravity of the connection zone defined by the surface situated upstream of the points P1 and P3 relative to the direction of flow of the fluid is on the axis of smallest inertia of the surface of the theoretical profile, preferably as close as possible to the center of gravity of said section.

Other features and advantages of the present invention will emerge from the description made below, with reference to the appended drawings which illustrate an exemplary embodiment thereof possessing no limitative character.

FIG. 1 illustrates the position of a recrystallization zone on the pressure face and suction face on rough cast monocrystalline solid blades.

FIGS. 2*a*, 2*b* and 2*c* illustrate tests of different thickenings of the root, over the whole periphery of the profile.

Figure 1:
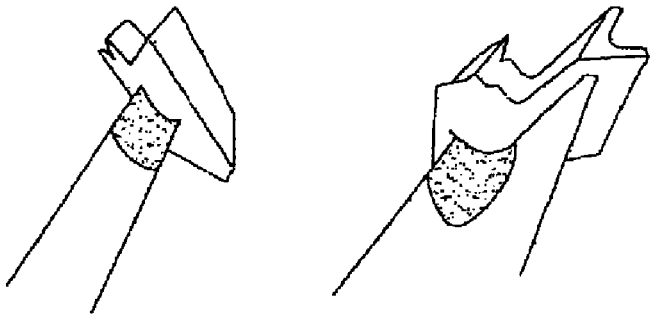
Fig. 1 BACKGROUND ART
Figure 2A:
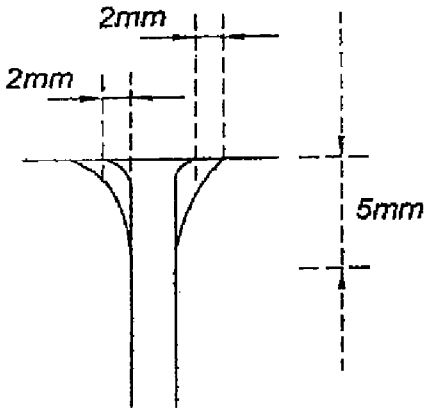
Fig. 2a BACKGROUND ART
Figure 2B:
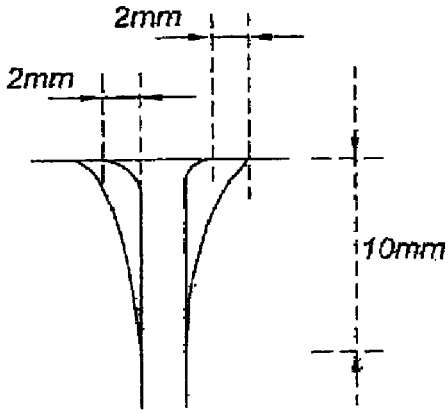
Fig. 2b BACKGROUND ART
Figure 2C:
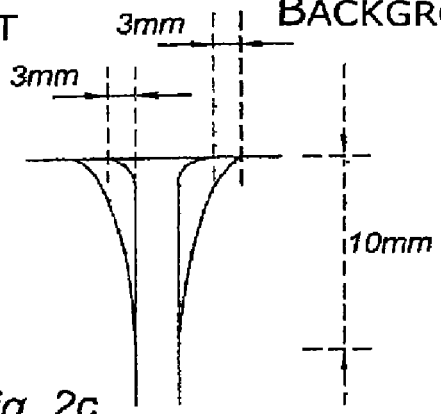
Fig. 2c BACKGROUND ART
Figure 3:
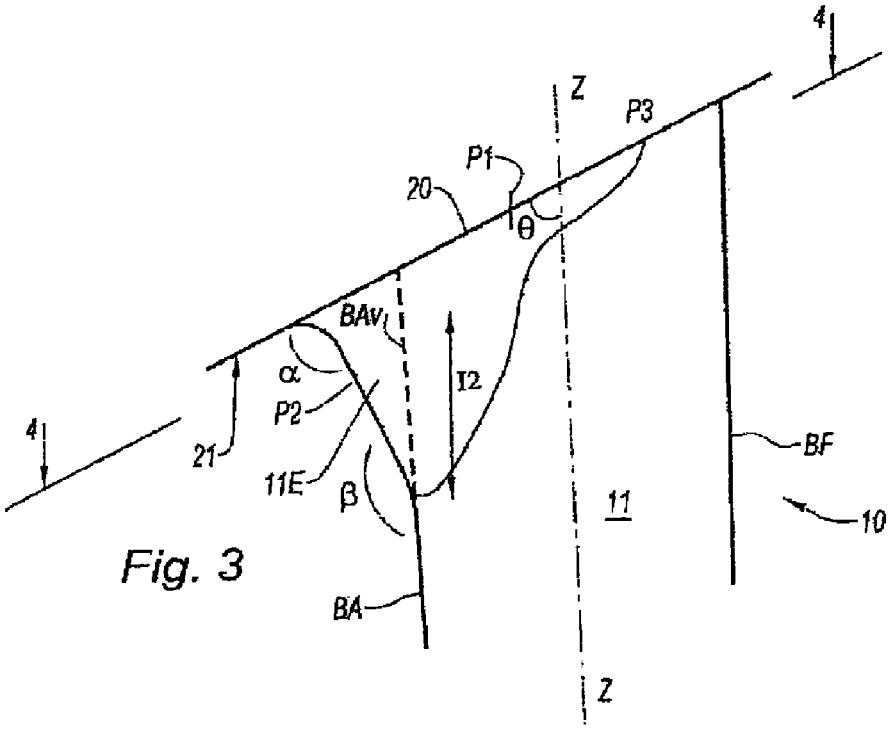
FIG. 3 represents, seen in profile and schematically, the end of a blade with a heel whose connection zone is thickened according to the invention.
Figure 4:
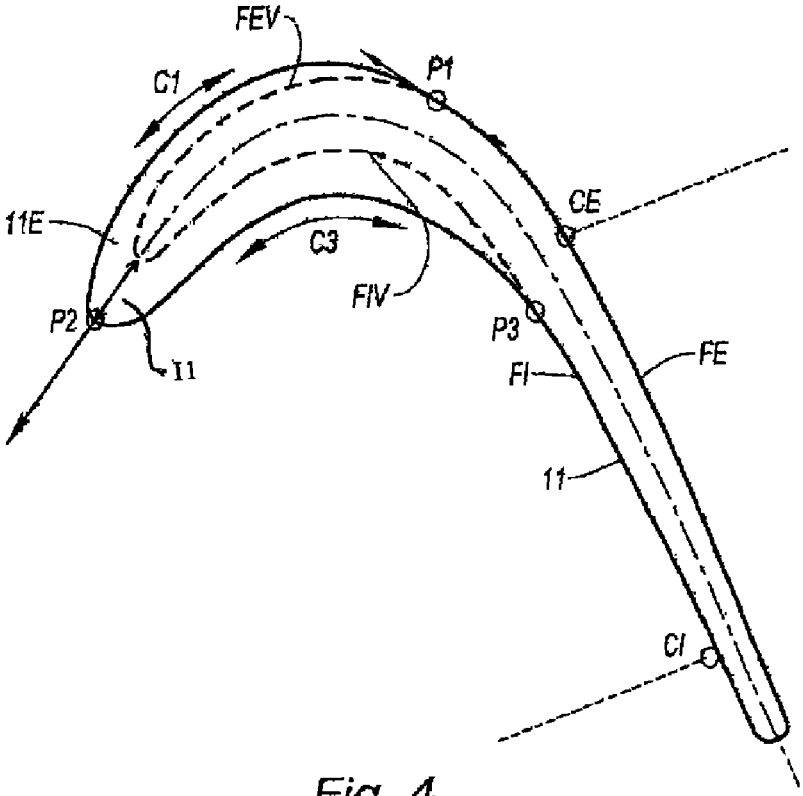
FIG. 4 represents the blade of FIG. 3 seen in section in a direction 4-4 placed in parallel and immediately beneath the heel.

FIGS. 3 and 4 show a blade 10 comprising an airfoil 11 and an endpiece 20 (in this instance a heel), represented schematically. It may be a platform in the case of the radially inner end; in the rest of the description consideration will be given to the situation of a heel at the radially outer end of the airfoil. The heel at the end of the airfoil 11 has the function of sealing the stream and comprises on its outer surface seal lips that are not shown. The endpiece 20 has an airfoil end face 21, turned toward the airfoil. This face forms a non-zero angle $\theta$ with the axis ZZ of the airfoil. In the example shown, the angle $\theta$ is approximately 50°. The airfoil 11 of the turbomachine comprises a pressure face FI and a suction face FE extending between a leading edge BA and a trailing edge BF.

The blade 10 comprises a connection zone between the airfoil and the heel forming an extra thickness or a fattening 11E from a point P1 on the suction face FE, and a point P3 on the pressure face FI. This fattening is the excess material relative to the theoretical profile of the airfoil, that is to say that which it would have without taking account of the technical problem solved by the invention, directly beneath the end surface 21 and which is represented by the dashed lines BAv, FIv and FEv in FIGS. 3 and 4.

The fattening is defined by the rules described below. The point P1 is situated upstream of the suction neck line CE, the neck being the minimum distance separating two adjacent blades. The connection zone, at P1, is tangential to the blade 11. Seen in section in directions parallel to the surface 21, the profile C1 of the suction face of the connection zone 11E is substantially the same, at least partially, as that of the suction face zone FEv of the theoretical airfoil, with linking portions ensuring continuity with the rest of the profile of the airfoil. This similarity is defined by the fact that the profile C1 is deduced from that of the zone FEv by a combination of geometric transformations of the translation, change of scale and/or affinity type. The thickness of the connection zone 11E on the suction face must be minimal. This thickness is defined by the casting experiment; it is required to minimize the losses of aerodynamic performance.

The addition of pressure face material is defined by the rules described below. The point P3 is situated upstream of the pressure face neck line CI. The connection zone, at P3, is tangential to the airfoil 11. The profile C3 of the pressure face of the connection zone 11E is also similar to that of the pressure face zone FIv of the theoretical airfoil and is deduced therefrom by a combination of geometric transformations of the same type as for the suction face.

The positioning of the point P3 is determined with a certain margin for the purpose of optimizing the position of the center of gravity of the connection zone 11E. The movement of the point P3 toward the point CI makes it possible to move the center of gravity of the connection zone toward the point CI and vice versa. The optimization of the position of the center of gravity of the connection zone allows the airfoil to maintain its mechanical strength. The center of gravity of the connection zone is advantageously on the axis of smallest inertia of the surface of the theoretical profile, preferably as close as possible to the center of gravity of the surface of the theoretical profile.

The fattening of the connection zone at the pressure face is determined, on the one hand, by a minimal thickness, specified by the casting experiment, in order to comply with the flowability criteria, and, on the other hand, by a maximum thickness resulting from the section/weight objective in order to comply with the constraints of mechanical strength.

As noted above, the fattening is situated mainly at the leading edge BA of the airfoil. The leading edge BA is the line formed of the points furthest upstream on the profile of the airfoil and the trailing edge BF is the line of the points furthest downstream. Upstream and downstream are defined with respect to the flow of the gas around the airfoil. The line of the points P2 of the connection zone, which are also situated furthest upstream on the airfoil, is situated in line with the line of the leading edge BA and of the skeleton S of the airfoil. The skeleton of the airfoil, also called the framework or midline, is all of the points that are equidistant from the suction face FE and the pressure face FI.

The connection zone, on which the line of the points P2 that is preferably rectilinear is positioned, give or take the fillets for connection with the end face 21 of the airfoil and with the leading edge, is defined by angles $\alpha$ and $\beta$. The angle $\alpha$ corresponds to the angle between the end face of the airfoil and the line of the points P2. The angle $\beta$ is the angle between the line of the points P2 and the leading edge BA. These two angles are defined by the casting experiment in order to comply with the flowability criterion. The angle $\alpha$ is situated in a range of between 75° and 90°. As for the angle $\beta$, it is linked to the angle $\alpha$. The connection between the zone 11E and the surface 21 is not secant but is progressive with a rounding.

The point of the line of the points P2 on the face 21 is at a distance I1 from the theoretical leading edge BAv. The length I1 is determined so as to retain the aerodynamic criteria of the airfoil. Its length is sufficient to preserve the mechanical strength of the heel.

The height I2 represents the height of the connection zone close to the leading edge. This height is between a minimal value and a maximal value. The minimal value must satisfy the flowability criterion; the minimal value is determined by the casting experiment. Furthermore, the maximal value aims to comply with the objective of the section/weight law in order to preserve the mechanical strength.

Figure 5:
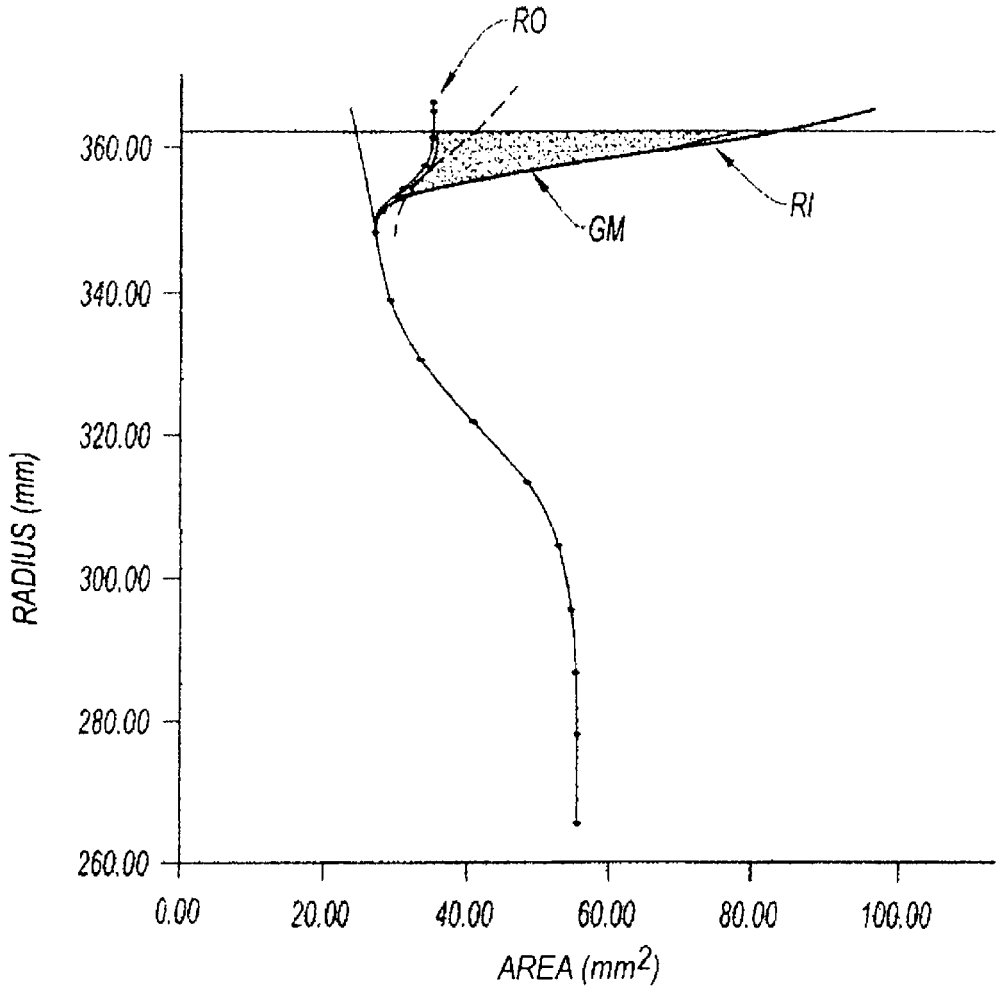
FIG. 5 is a graph of the law of the areas of the sections of the blade according to the invention along the axis ZZ, compared with that of a nonoptimized root extending over the whole periphery of the profile.

FIG. 5 is a graph with, for the axis of the abscissas, the area of a section of the airfoil along a plane perpendicular to the leading edge of the theoretical profile, and for the axis of the ordinates, the radius at the corresponding point of the leading edge, representing the law of evolution of the section/weight along the stream. It is noted that the geometry of the root of the invention makes it possible to considerably reduce the section and the problems associated therewith. The weight saving GM is illustrated by the surface area between the curve portion representing the area of the sections through the initial root RI as it would have been made without the invention, that is to say with a thickening over the whole periphery of the airfoil and the root RO according to the invention. It is noted that the section of the airfoil, which reduces as it approaches the heel, increases in the connection zone, but remains less than the value that it has in the lower portion of the airfoil.

The invention claimed is:

1. A monocrystalline turbine blade for a turbomachine turbine rotor, said blade being cast and directionally solidified, comprising:

an airfoil with a leading edge, a pressure face, a suction face, a trailing edge, a skeleton and having a longitudinal axis, the faces having a neck line, respectively a pressure face neck and a suction face neck relative to the adjacent blade in the turbomachine rotor of which it forms an element, the airfoil having a theoretical profile;

an endpiece of the airfoil, having an airfoil end face on a stream side, forming an angle with the axis; and a connection zone between the airfoil and said airfoil end face, said connection zone forming a fattening of the airfoil, wherein said connection zone extends about the leading edge between a point P1 situated on the suction face of the airfoil and on the end face of the endpiece upstream of the suction face neck with reference to the direction of flow of the fluid and a point P3 situated on the pressure face of the airfoil and on the end face of the endpiece upstream of the pressure face neck, wherein a line of points situated furthest upstream relative to a direction of flow of fluid in the connection zone P2 is situated in line with the leading edge on the skeleton, and wherein a surface of the connection zone has a profile C1 between the line of the points P2 and the point P1 which is similar to the suction face surface of the theoretical profile of the airfoil, and a surface of the connection zone has a profile C3 between the line of the points P2 and the point P3 which is similar to the pressure face surface of the theoretical profile of the airfoil.

2. The blade as claimed in claim 1, wherein a section of said airfoil in the connection zone, measured perpendicularly to a leading edge of the theoretical profile, increases as it goes toward said endpiece, while remaining less than the section of the blade in its lower portion.

3. The blade as claimed in claim 1, wherein the line of the points P2, excluding fillets for connection to the airfoil end face and to the leading edge of the blade, is rectilinear and forms with the airfoil end face an angle $\alpha$ at least equal to 75°.

4. The blade as claimed in claim 3, wherein the angle $\alpha$ is less than 90°.

5. The blade as claimed in claim 1, wherein a curvature of the connection zone, in at least one sectional plane perpendicular to a leading edge of the theoretical profile, at the corresponding point of the line of the points P2 is a function of the curvature of the leading edge of the theoretical profile and of the distance separating, in said sectional plane, the point of the line of the points P2 from the leading edge of the theoretical profile.

6. The blade as claimed in claim 5, wherein the radius of curvature at said point of the line of the points P2 is equal to a corresponding radius of curvature on the theoretical profile, plus a third of said distance.

7. The blade as claimed in claim 1, wherein the surface of the zone of connection to the point P1 is tangential along its end to the suction face of the blade.

8. The blade as claimed in claim 1, wherein the surface of the connection zone at P3 is tangential along its end to the pressure face of the blade.

9. The blade as claimed in claim 1, wherein the profile C1 is deduced, at least partially, from that of the suction face surface of the theoretical airfoil by a combination of geometric transformations of the translation, change of scale and/or affinity type.

10. The blade as claimed in claim 1, wherein the profile C3 is deduced, at least partially, from that of the pressure face surface FI of the theoretical airfoil by a combination of geometrical transformations of the translation, change of scale and/or affinity type.

11. The blade as claimed in claim 1, wherein, in at least one sectional plane perpendicular to a leading edge of the theoretical profile, a center of gravity of the connection zone defined by a surface situated upstream of the points P1 and P3 relative to the direction of flow of the fluid is on the axis of smallest inertia of the surface of the theoretical profile.

12. A turbomachine module comprising at least one blade as claimed in claim 1.

13. A turbomachine comprising at least one blade as claimed in claim 1.

14. The blade as claimed in claim 3, wherein an angle between the line of the points P2 and the leading edge is based on the angle $\alpha$.

15. The blade as claimed in claim 11, wherein the center of gravity of the connection zone is as close as possible to a center of gravity of the theoretical profile.

* * * * *